US006805538B2

(12) United States Patent
Djordjevic

(10) Patent No.: US 6,805,538 B2
(45) Date of Patent: Oct. 19, 2004

(54) FUEL TANK MOUNTED, MOTORIZED HIGH PRESSURE GASOLINE PUMP

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/332,030

(22) PCT Filed: Aug. 13, 2001

(86) PCT No.: PCT/US01/25212

§ 371 (c)(1),
(2), (4) Date: Jan. 3, 2003

(87) PCT Pub. No.: WO02/14677

PCT Pub. Date: Feb. 21, 2002

(65) Prior Publication Data

US 2003/0206814 A1 Nov. 6, 2003

(51) Int. Cl.[7] ..... F04B 23/02

(52) U.S. Cl. ..... 417/201; 417/203; 417/205; 417/273; 417/462; 137/565.17; 137/565.31

(58) Field of Search ..... 417/201, 203, 417/205, 423.3, 423.9, 273, 460, 462; 137/565.17, 565.31, 545

(56) References Cited

U.S. PATENT DOCUMENTS

| | | | | | |
|---|---|---|---|---|---|
| 2,865,618 | A | * | 12/1958 | Abell | 261/93 |
| 3,682,565 | A | | 8/1972 | Yarger | 417/270 |
| 4,014,628 | A | * | 3/1977 | Ruseff et al. | 417/203 |
| 4,281,971 | A | * | 8/1981 | Kouns | 417/203 |
| 4,682,936 | A | * | 7/1987 | Suzuki et al. | 417/366 |
| 4,859,073 | A | * | 8/1989 | Howseman, Jr. et al. | 366/195 |
| 5,030,065 | A | * | 7/1991 | Baumann | 417/273 |
| 5,096,391 | A | * | 3/1992 | Tuckey | 417/423.3 |
| 5,360,322 | A | * | 11/1994 | Henein et al. | 417/313 |
| 5,773,716 | A | * | 6/1998 | Antonioli et al. | 73/119 A |
| 5,864,055 | A | * | 1/1999 | Borrione et al. | 73/35.09 |
| 6,078,118 | A | * | 6/2000 | Reinartz et al. | 310/89 |
| 6,179,558 | B1 | * | 1/2001 | Eastman, III et al. | 415/121.2 |
| 6,345,609 | B1 | * | 2/2002 | Djordjevic | 123/509 |
| 6,378,164 | B1 | * | 4/2002 | Berfield | 15/353 |
| 6,406,272 | B2 | * | 6/2002 | Ruthardt et al. | 417/273 |
| 6,589,029 | B1 | * | 7/2003 | Heller | 417/415 |

FOREIGN PATENT DOCUMENTS

| | | |
|---|---|---|
| DE | 197 26 572 A1 | 12/1998 |
| EP | 0 821 156 A2 | 1/1998 |
| FR | 1.563.951 | 4/1969 |
| WO | WO 99/43947 | 9/1999 |

* cited by examiner

*Primary Examiner*—Justine R. Yu
*Assistant Examiner*—Emmanuel Sayoc
(74) *Attorney, Agent, or Firm*—Alix, Yale & Ristas, LLP

(57) ABSTRACT

A pump, for supplying high pressure fuel from a fuel tank to an engine via a common rail, includes a motor assembly (20) mounted on top of the fuel tank, a pump assembly (26) positioned within the fuel tank, and a support column (32) rotatably connecting the motor assembly to the pump assembly. A high pressure pump sub-assembly (46) includes a pump body (48) having a drive bore (50) and multiple plunger bores (60) formed therein. The external profile of a drive member (58) which is rotatable within the drive bore engages the radially inner end of pumping plungers (62) disposed in each of the plunger bores for a portion of each revolution to reciprocally move the plungers between radially inner and outer limit positions. Reciprocation towards the inner limit position induces a low pressure in the radially outer end of the plunger bore, thereby drawing fuel via the drive bore without the aid of a low pressure pump.

16 Claims, 4 Drawing Sheets

FUEL TANK MOUNTED, MOTORIZED HIGH PRESSURE GASOLINE PUMP

CROSS-REFERENCE TO RELATED APPLICATIONS

This is the national stage of International Application No. PCT/USO1/25212 filed Aug. 13, 2000 which claims priority from U.S. Provisional Application Ser. No. 60/225,115 filed Aug. 14, 2000

BACKGROUND OF THE INVENTION

A number of potential advantages have led the automotive industry to look with increasing interest toward utilizing common rail high pressure direct injection for gasoline engines. Certain difficulties seem to stand in the way of fully achieving the advantages.

The pressurization of fuel to high levels (e.g., above 100 bar) requires considerable pumping power, which generates considerable heat. Moreover, the industry is looking to even higher rail pressures, above 200 bar. This heat could be dissipated to a large extent, if all the fuel that is pressurized can be quickly injected into the engine cylinders. This is not possible, however, because the fuel pump flow rate is typically sized for engine cranking, which may be at 20–30 bar pressure at a relatively high quantity flow rate, whereas typical steady state cruising conditions would require much lower quantity flow rates at 100 bar. Therefore, in a conventional pumping scheme, the volume of fuel raised to injection pressure during the course of an hour of typical vehicle use, is much greater than the volume of fuel actually injected during that same hour of use. Although pre-metering and various spill control techniques can be used to some advantage in this regard, none of these techniques satisfactorily regulates the power output of the high pressure pump itself.

Another difficulty is encountered with high pressure pumps that are driven directly by the engine (e.g., crank shaft, cam shaft, accessory belt). During transients when fuel demand is low (e.g., downhill or during gear shifting), the engine continues to turn and the pump continues to deliver high pressure fuel to a common rail that may already be at maximum pressure.

SUMMARY OF THE INVENTION

In the invention, a high pressure rotary pump is intimately coupled to an electric motor as a packaged unit situated at the vehicle fuel tank, with the speed of the motor and thus the pumping rate of the high pressure pump, being responsive to the rail pressure. Thus, the motor can quickly increase the drive shaft speed and thus provide high pumping volume during cranking, while reducing speed to a low level with, associated low pumping volume when the vehicle is cruising. Similarly, the motor can intermittently increase speed as needed to accommodate load demand during acceleration, or in essence stop the pump drive when the vehicle is coasting. The aspects sought to be protected, concern the manner in which the motor and pump are integrated and function together as a package.

Briefly stated, the invention in a preferred form is a pump for supplying high pressure fuel from a fuel tank to an engine via a common rail. The pump includes a motor assembly mounted on top of the fuel tank, a pump assembly positioned within the fuel tank, and a support column connecting the motor assembly to the pump assembly. The pump assembly comprises a high pressure pump subassembly including a pump body having a drive bore and multiple plunger bores formed therein, where a radially inner end of each plunger bore opens into the drive bore. The external profile of a drive member which is rotatable within the drive bore engages the radially inner end of pumping plungers disposed in each of the plunger bores for a portion of each revolution to reciprocally move the plungers between radially inner and outer limit positions. Reciprocation of each pumping plunger towards the inner limit position induces a low pressure in the outer end of the plunger bore, thereby drawing fuel into the outer end of the plunger bore via the drive bore without the aid of a low pressure pump. Reciprocation of each pumping plunger towards the outer limit position induces a high pressure in the outer end of the plunger bore, thereby discharging fuel from the outer end of the plunger bore into the common rail via the high pressure line.

The pump assembly also comprises a fine filter sub-assembly mounted to the top end portion of the pump body. The fine filter sub-assembly includes a cannister having an upper sleeve portion, a middle housing portion, a radially extending shoulder connecting the sleeve portion to the housing portion, and a lower mounting portion separated from the housing portion by a circumferential, radially inward extending protrusion. The top end portion of the pump body is received within the cannister mounting portion such that the protrusion rests on the pump body. An O-ring disposed in a circumferential groove in the top end portion of the pump body provides a fluid-tight seal between cannister and the pump body. Fuel vapor is vented from the fine filter sub-assembly via a vent orifice in the shoulder, with a check valve positioned in the vent orifice preventing backflow into the cannister. The outer surface of fine filter element disposed within the cannister housing portion, together with the inner surface of the cannister housing portion, forms an annular column and the inner surface of the fine filter element forms a cavity in fluid communication with the drive bore.

The pump assembly also comprises a coarse filter sub-assembly a coarse filter sub-assembly mounted to the bottom end portion of the pump body. The coarse filter sub-assembly includes a housing having an inlet in fluid communication with the fuel tank and an outlet in fluid communication with the annular column of the fine filter assembly. A coarse filter screen, is disposed intermediate the inlet and outlet of the housing. The housing further has a plurality of downwardly extending, circumferentially spaced spacers defining a plurality of slots which form the inlet. Each of the spacers has a bottom end which engages the inside surface of the bottom of the fuel tank to position the coarse filter screen at a distance above the fuel tank inner surface.

According, it is an object of the present invention to provide a high pressure gasoline common rail direct injection fuel supply system, in which the high pressure discharge of the means for raising and maintaining the rail pressure above 100 bar, is responsive to engine demand. The energy imparted to the discharged fuel (e.g., pressure increase) is over time, significantly reduced relative to conventional systems.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

With reference to the drawings wherein like numerals represent like parts throughout the several figures, a direct injection fuel pump in accordance with the present invention is generally designated by the numeral 10.

Figure 1:
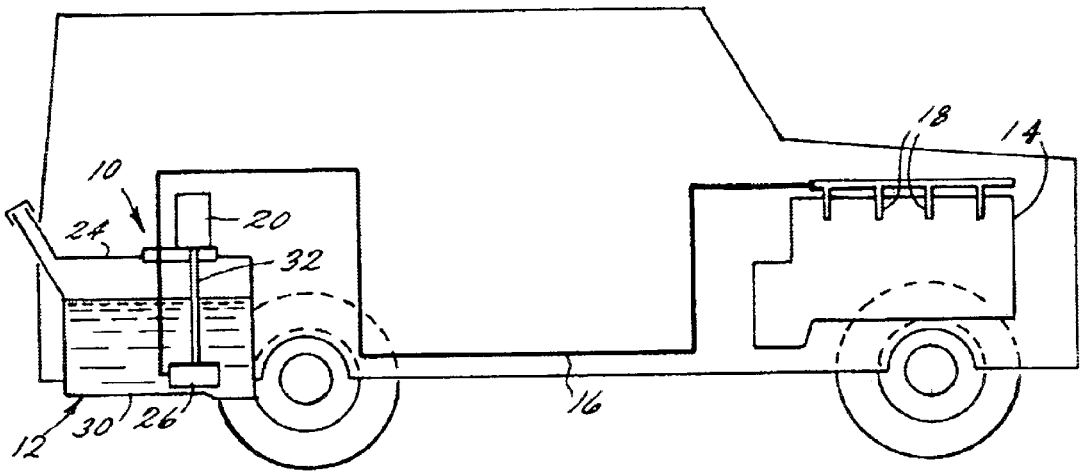
FIG. 1 is a schematic view of a road vehicle having a direct injection fuel pump in accordance with the invention.

In a preferred embodiment, a direct injection fuel pump 10 in accordance with the invention is a gasoline direct injection (GDI) pump which is mounted on and within a vehicle's fuel tank 12. In a typical vehicle, FIG. 1, the engine 14 is disposed in the forward part of the vehicle and the fuel tank 12 is disposed in the rear part of the vehicle. The direct injection fuel pump 10 supplies fuel at high pressure through a supply line 16 to multiple fuel injectors 18 mounted in the engine 14 and includes three main sections: 1) a motor assembly 20 mounted on the exterior surface 22 of the top 24 of the fuel tank 12; 2) a high pressure pump assembly 26 resting on the interior surface 28 of the bottom 30 of the fuel tank 12; and 3) a support column 32 connecting the motor assembly 20 to the pump assembly 26.

Figure 2:
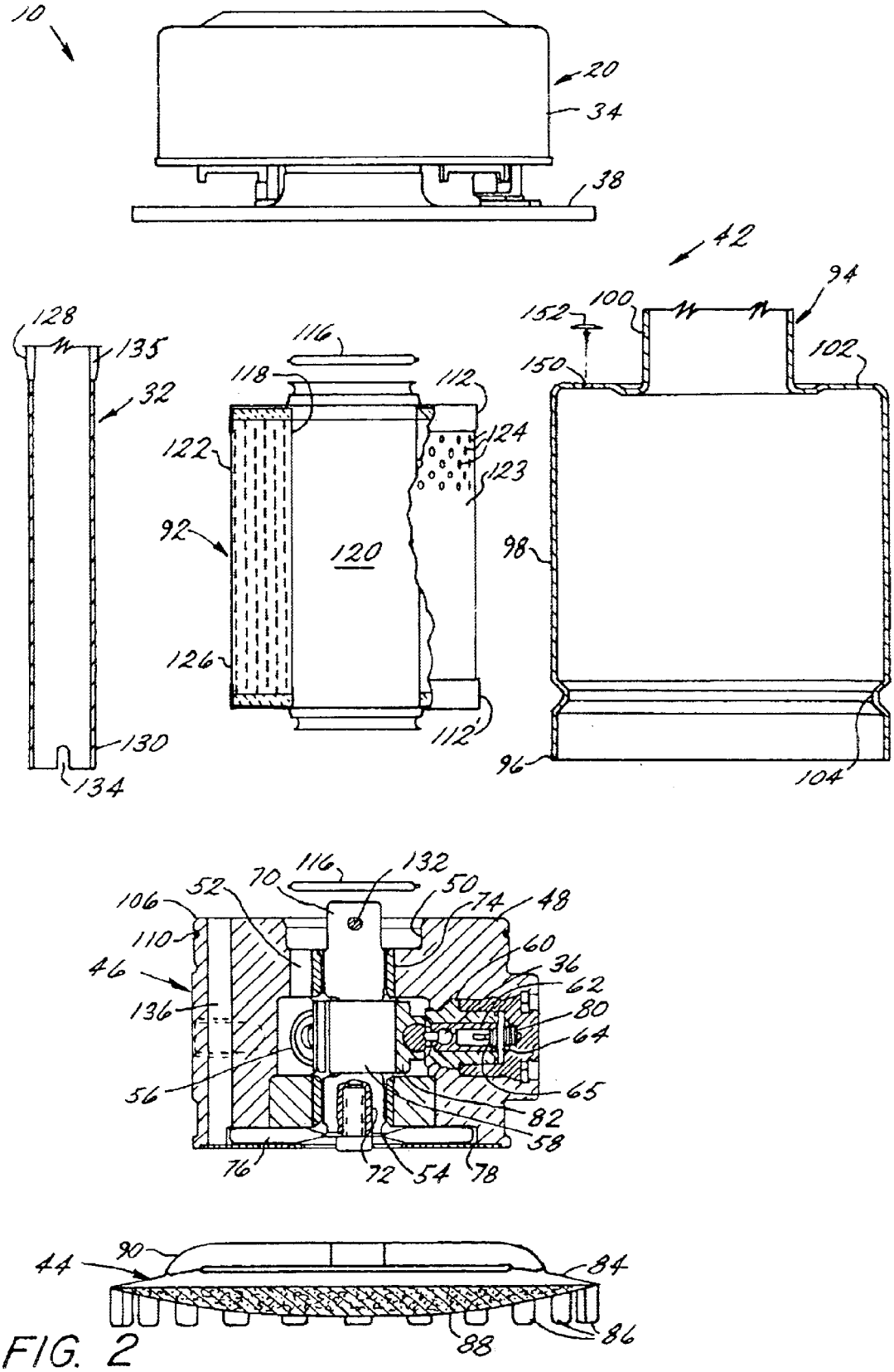
FIG. 2 is an enlarged, exploded view, partly in cross section and partly broken away, of the direct injection fuel pump of FIG. 1.
Figure 3:
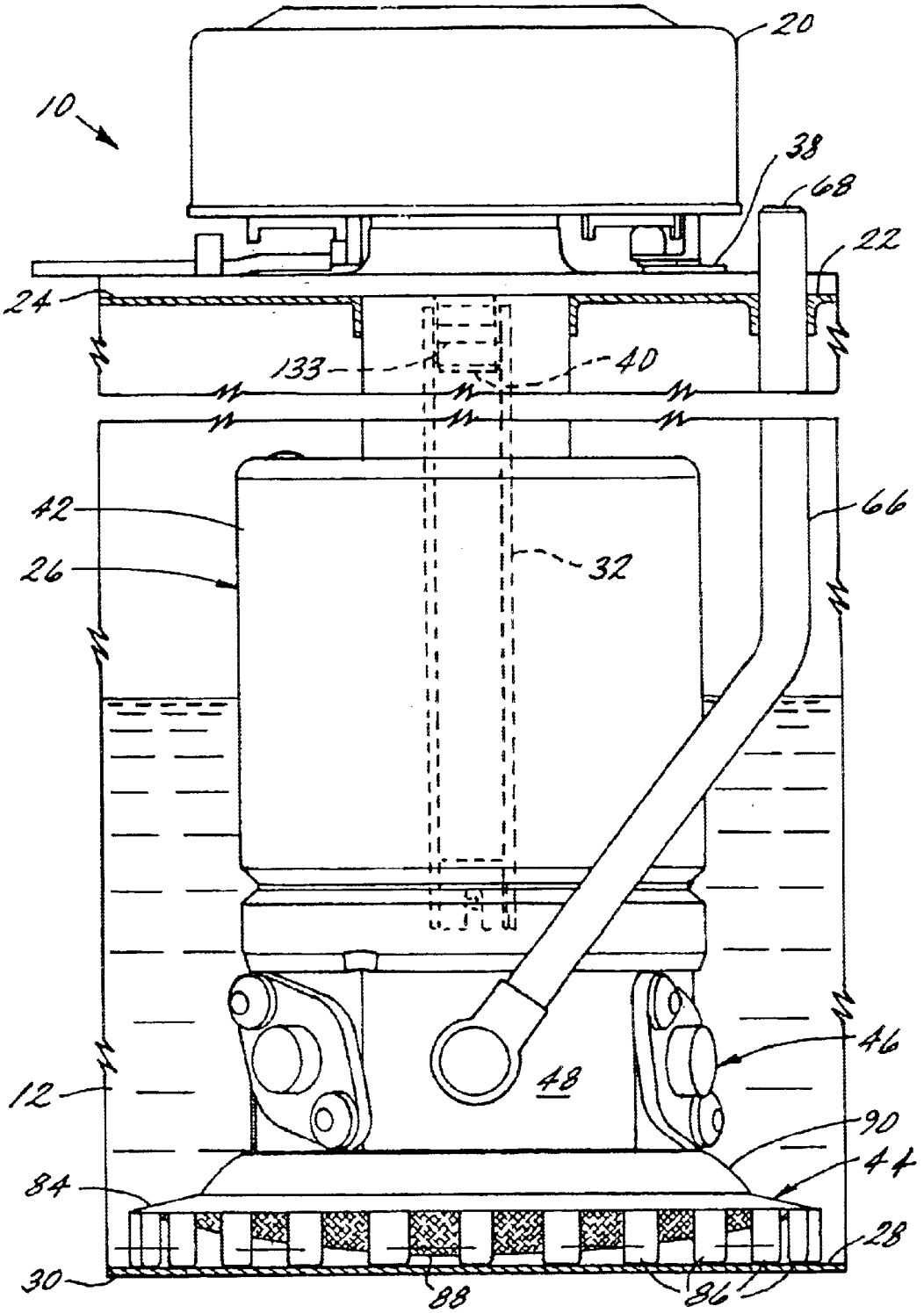
FIG. 3 is an enlarged, side view, partly in phantom, of the direct injection fuel pump of FIG. 1.
Figure 4:
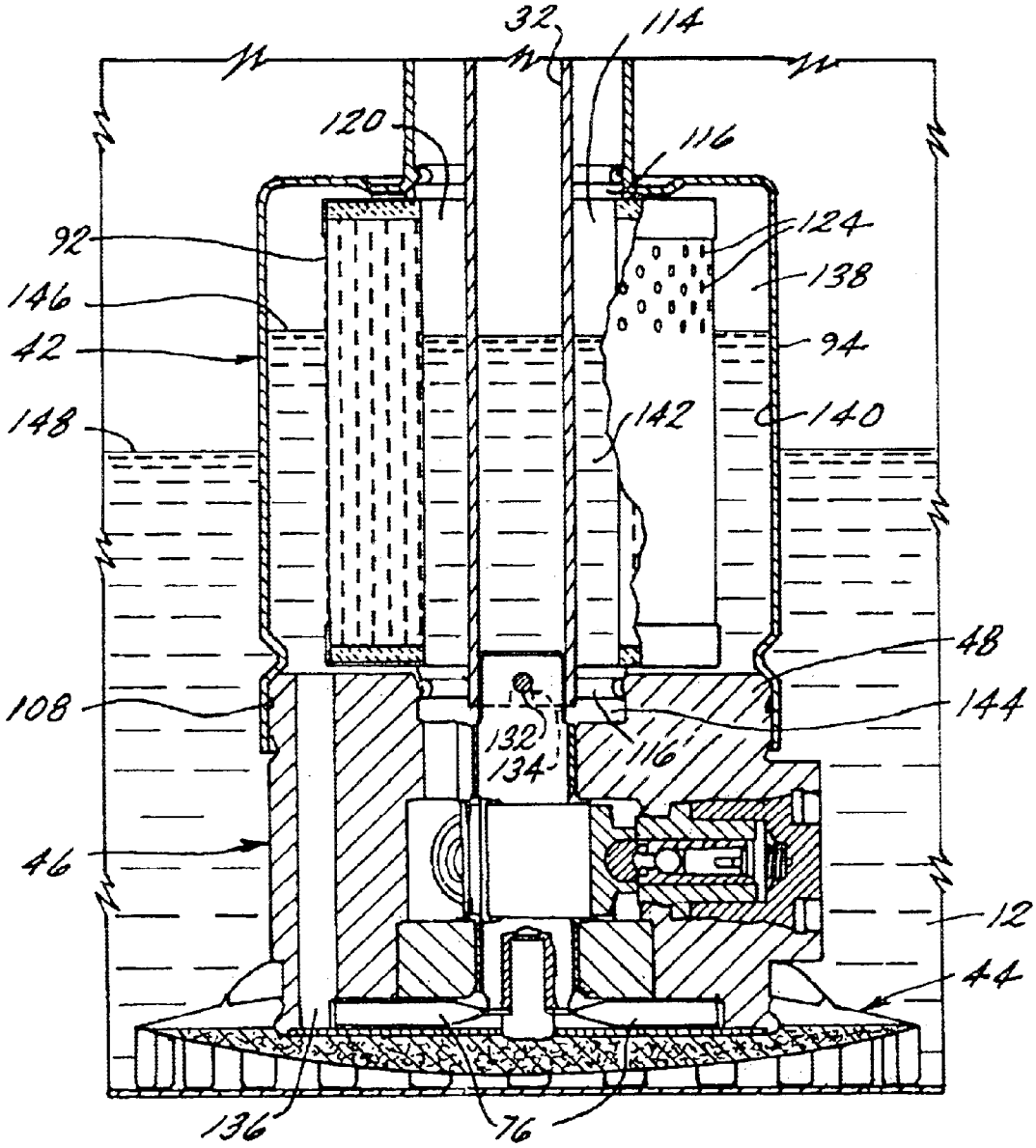
FIG. 4 is an enlarged, cross section view of the direct injection fuel pump and fuel tank of FIG. 1.

With reference to FIGS. 2–4, the motor assembly 20 includes a motor 34, including integral electronics (not shown). The motor 34 is mounted to the exterior surface 22 at the top 24 of the fuel tank 12 via a mounting plate 38. Preferably, the motor 34 is a 12 volt DC motor, receiving power from the vehicle electrical system, and has a power rating which is closely matched to the operating requirements of the engine 14. The motor shaft 40 of the electric motor 34 is sealed by a small low friction radial seal (not shown) to prevent fuel vapors from escaping from the tank 12.

The pump assembly 26 includes an upper fine filter sub-assembly 42, a lower coarse filter sub-assembly 44, and a pump sub-assembly 46 disposed intermediate the filter sub-assemblies 42, 44. The pump sub-assembly 46 includes a pump body 48 having a drive bore 50 formed therein which includes upper and lower drive shaft portions 52, 54 and an intermediate portion 56 in which an eccentric drive member 58 is rotatable. At least one, and preferably multiple equi-angularly spaced plunger bores 60 extend radially from the intermediate portion 56 of the drive bore 50. A pumping plunger 62 is situated in each plunger bore 60 for reciprocal radial movement therein as a result of the eccentric rotation of the drive member 58. A pumping chamber 64 is formed at the radially outer end of each plunger bore 60. As the pumping plunger 62 disposed within the associated plunger bore 60 is urged radially to an inner limit position inward by rotation of the drive member 58, the pressure within the pumping chamber 64 is reduced, thereby opening an inlet check valve 36 and allowing fuel to be delivered to the pumping chamber 64. Thereafter, as the pumping plunger 62 is urged radially outward to an outer limit position by further rotation of the drive member 58, the fuel in the pumping chamber 64 undergoes high pressure thereby opening an outlet check valve 65 and allowing the fuel to flow through a discharge passage into a common rail via a high pressure line 66. The high pressure line 66 extends upwardly through the top 24 of the fuel tank 12 to an external high-pressure outlet 68 located on the motor mounting plate 38.

The eccentric drive member 58 is rigidly connected (preferably integrally) to a drive shaft having an upper segment 70 which extends longitudinally through the upper drive shaft portion 52 of the drive bore 50 to an upper end and a lower segment 72 which extends through the lower drive shaft portion 54 of the drive bore 50 to a lower end. The eccentric drive member 58 is supported in the intermediate portion 56 of the drive bore 50 by substantially identical, self-lubricated upper and lower bushings 74 disposed in the upper and lower drive shaft portions 52, 54 of the drive bore 50, respectively. An impeller 76 is carried on the lower segment 72 of the drive shaft within a lower recess 78 in the pump body 48. The impeller 76 insures sufficient positive pressure at the pump inlet (sump) at all speeds and temperatures thereby minimizing the formation of vapor cavities.

It should be understood that, typically, the pumping chamber 64 is formed in a removable plunger plug 80 which penetrates the pump body 48. For the purposes of the present description, however, it can be assumed that the plunger plug 80 is integral with the pump body 48. Each pumping plunger 62 is connected to a cam shoe 82, and retention means urges the cam shoe 82 against the external profile of the eccentric drive member 58. Preferably, the radially inner end of the pumping plunger 62 has a substantially spherical shape and is carried in a cooperating cradle extending from the shoe 82, thereby providing a pivotal connection.

The pump body 48 is mounted on top of the coarse filter sub-assembly 44. The coarse filter sub-assembly 44 includes a housing 84 having multiple, downwardly extending spacers 86 which rest on the bottom 30 of the fuel tank 12. A coarse filter screen 88 extends substantially horizontally across the coarse filter housing 84 at a vertical position which is intermediate the bottom of the pump body 48 and the bottom ends of the spacers 86, thereby insuring a certain minimum distance between the coarse screen 88 and the interior surface 28 of the fuel tank 12. A series of resilient fingers 90 project downward from the pump body 48 to engage the outer edge of the coarse filter housing 84 biasing the housing towards the bottom 30 of the tank 12 and thereby compensating for any longitudinal tolerances. Preferably, the coarse filter screen 88 is a 150 to 300 micron mesh, which in combination with the extremely coarse filtering action of the spacers 86, acts to protect the impeller 76 and reduce the rate at which the fine filter element 92 (discussed below) is loaded with particulate matter.

The fine filter sub-assembly 42 is mounted on top of the pump body 48. The fine filter sub-assembly 42 includes a cannister 94 having a lower mounting portion 96, a middle housing portion 98, and an upper sleeve portion 100. The outer diameter of the sleeve portion 100 is smaller than the outer diameter of the housing portion 98, forming an upper shoulder 102. The mounting portion 96 is separated from the housing portion 98 by a circumferential, radially inward extending protrusion 104. The mounting portion 96 receives an upper end portion 106 of the pump body 48 such that protrusion 104 rests on the upper surface of the pump body 48. An O-ring 108 disposed in a circumferential groove 110 in the upper end portion 106 of the pump body 48 provides a fluid-tight seal between the mounting portion 96 of the cannister 94 and the pump body 48.

A fine filter element 92 is disposed within the housing portion 98 of the cannister 94. Preferably, the fine filter element 92 has a 2 to 5 micron element and is sized to store the amount of debris expected to accumulate over the entire life expectancy of the vehicle whereby the fine filter sub-assembly 42 does not require servicing over the lifetime of the vehicle. The fine filter element 92 has upper and lower end caps 112, 112', each having an axial opening 114. An upper sealing grommet 116 extends upwardly from the periphery of the opening 114 in the upper end cap 112 to sealingly engage the inner surface of the canister sleeve portion 100. A lower sealing grommet 116' extends downwardly from the periphery of the opening 114 in the lower end cap 112' to sealingly engage the inner surface of the upper drive shaft portion 52 of the drive bore 50. An inner surface 118 of the fine filter element 92 defines a cavity 120 which together with openings 114 and the orifices in the upper and lower sealing grommets 116, define an axial bore extending through the fine filter element 92. The upper portion 122 of the filter element housing 123 includes a plurality of holes 124 which complete the flow path through the fine filter element 92.

The support column 32 is a cardanic (tubular) drive joint, extending from an upper end portion 128 connected to the motor shaft 40, through the orifice of the upper sealing grommet 116, cavity 120, and the orifice of the lower sealing grommet 116' to a lower end portion 130 connected to the upper segment 70 of the drive shaft within the upper drive shaft portion 52 of the drive bore 50. Notches 134, 135 in the lower and upper end portions 130, 128 of the support column 32 receive cross pins 132, 133 extending from the upper segment 70 of the drive shaft and the motor shaft 40, respectively, to key the drive shaft to the support column 32.

As soon as the eccentric drive member 58 starts to rotate, a pressure drop induced by the suction of the pumping plungers 62 at low speed or by the impeller 76 at intermediate and high speeds forces fuel upwardly through the lower coarse filter assembly 44, through a fuel passage 136 in the pump body 48, and into an annular column 138 formed by the inner surface 140 of the fine filter canister 94 and the outer surface 126 of the fine filter element 92. The fuel then flows radially inward through holes 124 and the filter medium of the fine filter element 92 and forms a supply column 142 above the sump 144 of the high pressure pump 10. The height of holes 124 relative to the sump 144 ensures that the sump supply is maintained as a column 142 surrounding the drive joint 32 at a level 146 higher than the fuel level 148 in the tank 12. This small quantity of fuel in the sump supply column 142 insures the presence of a "solid" volume of fuel in the sump 144 even at low fuel level in the tank 12 and while driving either on a steep hill or in a long curve, when all the fuel is forced to one side of the tank 12 and a substantial air quantity could be ingested through the inlet screen 88.

Positive pressure generated by the impeller 76, proportional to motor speed, insures a sufficient amount of fuel flowing through the fine filter element 92, even if the filter element 92 is partially obstructed by contaminants. Some of the fuel within the fine filter sub-assembly 42 will evaporate and collect in the top portion of cannister 94, especially at higher speed and elevated temperature. A small vent orifice 150 located in the upper shoulder 102 of the cannister 94 allows the fuel vapors to be returned to the fuel tank 12, preventing vapor lock within the fine filter sub-assembly 42. A mushroom style check valve 152 prevents back flow through the vent orifice 150 and thus prevents contamination by the air when the fuel level is below the vent orifice 150.

It should be appreciated that a direct injection fuel pump 10 in accordance with the subject invention has several advantages over conventional fuel delivery systems. The elimination of the low pressure feed pump and high pressure control solenoid of the conventional fuel delivery systems more than offsets the higher cost of the electric motor 34. The inherent torque limits of the electric motor 34 limits the maximum rail pressure, eliminating the need for the pressure limiting valve of conventional systems. The heat generated by the motor 34 and electronics is dissipated outside of the tank 12, providing for minimum heat rejection inside of the fuel tank 12. Internal pump seals are not critical since all leakage paths lead back into the fuel tank 12. The pump 26 and motor 20 are exposed to minimum vibration, narrower temperature extremes, and the pump 26 is exposed only to fuel and normal fuel additives.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A fuel supply unit connected to a fuel tank for supplying high pressure fuel from the fuel tank to an engine via a common rail, the fuel tank having inner and outer surfaces, a top, and a bottom, the fuel supply unit comprising:

a motor assembly mounted on the outer surface of the top of the fuel tank, the motor assembly including a motor having a motor shaft extending into the fuel tank;

a pump assembly disposed within and adjacent to the bottom of the fuel tank, the pump assembly comprising a high pressure pump sub-assembly including a pump body having axially spaced top and bottom end portions and defining a plurality of plunger bores and a drive bore for providing fluid communication with the fuel tank, a pumping plunger disposed within each of the plunger bores, a drive member rotatable within the drive bore, and a high pressure line adapted for providing fluid communication with the common rail, each of the plunger bores extending radially from an inner end opening into the drive bore to an outer end in fluid communication with the high pressure line, each of the pumping plungers having radially inner and outer ends, the drive member having an external profile which engages the inner end of each pumping plunger for a portion of each revolution of rotation thereby actuating reciprocal movement of the pumping plungers within their respective plunger bores between radially inner and outer limit positions, the pump assembly also comprising a fine filter sub-assembly mounted to the top end portion of the pump body, the fine filter sub-assembly including a cannister and a fine filter element disposed within the cannister; and a support column rotatably connecting the motor shaft to the drive member;

wherein reciprocation of each pumping plunger towards the inner limit position induces a low pressure in the outer end of the plunger bore, thereby drawing fuel into the outer end of the plunger bore via the drive bore without the aid of a low pressure pump, and reciprocation of each pumping plunger towards the outer limit position induces a high pressure in the outer end of the plunger bore, thereby discharging fuel from the outer end of the plunger bore into the high pressure line.

2. The fuel supply unit of claim 1 wherein the pump body also defines a fuel passage in fluid communication with the drive bore extending from the bottom end of the pump body and the pump assembly also comprises a coarse filter sub-assembly mounted to the bottom end portion of the pump body, the coarse filter sub-assembly including a housing and a coarse filter screen, the housing having an inlet providing fluid communication with the fuel tank, the coarse filter screen being disposed intermediate the inlet of the housing and the bottom end of the pump body.

3. The fuel supply unit of claim 2 wherein the housing has a plurality of downwardly extending, circumferentially spaced spacers defining a plurality of slots forming the inlet, each of the spacers having a bottom end engaging the inside surface of the bottom of the fuel tank, the coarse filter screen extending substantially horizontally across the coarse filter housing at a vertical position intermediate the bottom end of the pump body and the bottom ends of the spacers.

4. The fuel supply unit of claim 2 wherein the coarse filter screen is a 150 to 300 micron mesh.

5. The fuel supply unit of claim 1 wherein the cannister has an upper sleeve portion, a middle housing portion, and a lower mounting portion separated from the housing portion by a circumferential, radially inward extending protrusion, the mounting portion receiving the top end portion of the pump body and the protrusion resting on the pump body, the high pressure pump assembly further including an O-ring disposed in a circumferential groove in the top end portion of the pump body, the O-ring providing a fluid-tight seal between the mounting portion of the cannister and the pump body.

6. The fuel supply unit of claim 5 wherein the sleeve and housing portions of the cannister each have an outside diameter, the diameter of the housing portion being greater than the diameter of the sleeve portion, defining an upper shoulder on the housing portion, the upper shoulder defining a vent orifice providing fluid communication with the fuel tank, the fine filter sub-assembly also including a check valve preventing flow from the fuel tank into the cannister.

7. The fuel supply unit of claim 5 wherein the fine filter element has upper and lower end caps and upper and lower sealing grommets, the upper and lower end caps each defining an axial opening, the upper sealing grommet extending upwardly from the periphery of the opening in the upper end cap to sealingly engage the sleeve portion of the cannister, the lower sealing grommet extending downwardly from the periphery of the opening in the lower end cap to sealingly engage the pump body.

8. The fuel supply unit of claim 1 wherein the fine filter element has an inner surface defining a cavity which together with the openings of the upper and lower end caps and the upper and lower sealing grommet, define an axial bore extending through the fine filter element.

9. The fuel supply unit of claim 8 wherein the support column is a tube extending from an upper end portion connected to the motor shaft, through the upper sealing grommet, the opening in the upper end cap, the cavity, the opening in the lower end cap, and the lower sealing grommet to a lower end portion connected to the drive member.

10. The fuel supply unit of claim 9 wherein the high pressure pump sub-assembly also includes an upper drive shaft extending axially upward from the drive member, the upper drive shaft having an upper segment and at least one peg extending laterally from the upper segment, the lower end portion of the support column defining an axially extending notch, the upper segment of the upper drive shaft being received within the tubular support column and the peg being received in the notch to key the drive shaft to the support column.

11. The fuel supply unit of claim 1 wherein the drive bore includes a lower recess portion extending from the bottom end of the pump body and the high pressure pump sub-assembly also includes a tower drive shaft and an impeller, the lower drive shaft extending axially downward from the drive member to a lower segment disposed within the recess portion of the drive bore, the impeller being mounted on the lower segment of the lower drive shaft.

12. The fuel supply unit of claim 1 wherein the fine filter element is a 2 to 5 micron element and is sized to store the amount of debris expected to accumulate over the entire life expectancy of the vehicle.

13. A fuel supply unit connected to a fuel tank for supplying high pressure fuel from the fuel tank to an engine via a common rail, the fuel tank having inner and outer surfaces, a top, and a bottom, the fuel supply unit comprising:

a motor assembly mounted on the outer surface of the top of the fuel tank, the motor assembly including a motor having a motor shaft extending into the fuel tank;

a pump assembly disposed within and adjacent to the bottom of the fuel tank, the pump assembly comprising a high pressure pump sub-assembly including a pump body having axially spaced top and bottom ends and top and bottom end portions, the pump body defining a fuel passage and a drive bore traversing the pump body from the top end to the bottom end, and a plurality of plunger bores, a pumping plunger disposed within each of the plunger bores, a drive member rotatable within the drive bore, and a high pressure line adapted for providing fluid communication with the common rail, each of the plunger bores extending radially from an inner end opening into the drive bore to an outer end in fluid communication with the high pressure line, each of the pumping plungers having radially inner and outer ends, the drive member having an external profile which engages the inner end of each pumping plunger for a portion of each revolution of rotation thereby actuating reciprocal movement of the pumping plungers within their respective plunger bores between radially inner and outer limit positions, a coarse filter sub-assembly mounted to the bottom end portion of the pump body, the coarse filter sub-assembly including a housing and a coarse filter screen, the housing having an inlet providing fluid communication with the fuel tank, the coarse filter screen being disposed intermediate the inlet of the housing and the bottom end of the pump body, a fine filter sub-assembly mounted to the top end portion of the pump body, the fine filter sub-assembly including a cannister and a fine filter element disposed within the cannister, the fine filter element having radially separated inner and outer surfaces, the inner surface defining a cavity in fluid communication with the drive bore of the pump body, the outer surface of the fine filter element and the cannister defining an annular column in fluid communication with the fuel passage of the pump body; and a support column rotatably connecting the motor shaft to the drive member;

wherein reciprocation of each pumping plunger towards the inner limit position induces a low pressure in the outer end of the plunger bore, thereby drawing fuel into the outer end of the plunger bore via the inlet and coarse filter screen of the coarse filter sub-assembly, the fuel passage of the pump body, the annular column, fine filter element, and cavity of the fine filter subassembly, and the drive bore of the pump body without the aid of a low pressure pump, and reciprocation of each pumping plunger towards the outer limit position induces a high pressure in the outer end of the plunger bore, thereby discharging fuel from the outer end of the plunger bore into the common rail via the high pressure line.

14. The fuel supply unit of claim 13 wherein the bottom end the pump body defines a recess, the drive member also has a lower drive shaft extending axially downward to a lower segment disposed within the recess and is rotatable between low and high speeds of rotation, including intermediate speeds between the low and high speeds of rotation, and the high pressure pump sub-assembly also includes ah impeller mounted on the lower segment of the lower drive shaft, the impeller having a profile adapted to provide additional motive force to the fuel traversing the pump at the intermediate and high speeds of rotation.

15. A fuel supply unit connected to a fuel tank for supplying high pressure fuel from the fuel tank to an engine via a common rail, the fuel tank having inner and outer surfaces and a bottom, the fuel supply unit comprising:

a motor assembly mounted on the outer surface of the fuel tank, the motor assembly including a motor having a motor shaft extending into the fuel tank;

a pump assembly disposed within the fuel tank, the pump assembly comprising a high pressure pump sub-assembly including a pump body having axially spaced first and second ends and defining a drive bore traversing the pump body from the first end to the second end and a plurality of plunger bores, a pumping plunger disposed within each of the plunger bores, a drive member rotatable within the drive bore, and a high pressure line adapted for providing fluid communication with the common rail, each of the plunger bores extending radially from an inner end opening into the drive bore to an outer end in fluid communication with the high pressure line, each of the pumping plungers having radially inner and outer ends, the drive member having an external profile which engages the inner end of each pumping plunger for a portion of each revolution of rotation thereby actuating reciprocal movement of the pumping plungers within their respective plunger bores between radially inner and outer limit positions, a coarse filter sub-assembly including a housing and a coarse filter screen, the housing having an inlet providing fluid communication with the fuel tank and an outlet, the coarse filter screen being disposed intermediate the outlet and the inlet of the housing, and a fine filter sub-assembly including a cannister and a fine filter element disposed within the cannister, the fine filter element having radially separated inner and outer surfaces, the inner surface defining a cavity in fluid communication with the drive bore of the pump body, the outer surface of the fine filter element and the cannister defining an annular column in fluid communication with the outlet of the housing of the coarse filter sub-assembly; and a support column rotatably connecting the motor shaft to the drive member;

wherein reciprocation of each pumping plunger towards the inner limit position induces a low pressure in the outer end of the plunger bore, thereby drawing fuel into the outer end of the plunger bore via the inlet and coarse filter screen of the coarse filter sub-assembly, the annular column, fine filter element, and cavity of the fine filter sub-assembly, and the drive bore of the pump body without the aid of a low pressure pump, and reciprocation of each pumping plunger towards the outer limit position induces a high pressure in the outer end of the plunger bore, thereby discharging fuel from the outer end of the plunger bore into the common rail via the high pressure line.

16. A fuel supply unit connected to a fuel tank for supplying high pressure fuel from the fuel tank to an engine via a common rail, the fuel tank having inner and outer surfaces, a top, and a bottom, the fuel supply unit comprising:

a motor assembly mounted on the outer surface of the top of the fuel tank, the motor assembly including a motor having a motor shaft extending into the fuel tank;

a pump assembly disposed within and adjacent to the bottom of the fuel tank, the pump assembly comprising a high pressure pump sub-assembly including a pump body having axially spaced top and bottom end portions and defining a plurality of plunger bores, a drive bore for providing fluid communication with the fuel tank, and a fuel passage in fluid communication with the drive bore extending from the bottom end of the pump body, a pumping plunger disposed within each of the plunger bores, a drive member rotatable within the drive bore, and a high pressure line adapted for providing fluid communication with the common rail, each of the plunger bores extending radially from an inner end opening into the drive bore to an outer end in fluid communication with the high pressure line, each of the pumping plungers having radially inner and outer ends, the drive member having an external profile which engages the inner end of each pumping plunger for a portion of each revolution of rotation thereby actuating reciprocal movement of the pumping plungers within their respective plunger bores between radially inner and outer limit positions, the pump assembly also comprising a coarse filter sub-assembly mounted to the bottom end portion of the pump body, the coarse filter sub-assembly including a housing and a coarse filter screen, the housing having an inlet providing fluid communication with the fuel tank, the coarse filter screen being disposed intermediate the inlet of the housing and the bottom end of the pump body, the high pressure pump sub-assembly also including at least one resilient finger projecting downward from the pump body to bias the coarse filter housing towards the bottom of the fuel tank; and a support column rotatably connecting the motor shaft to the drive member;

wherein reciprocation of each pumping plunger towards the inner limit position induces a low pressure in the outer end of the plunger bore, thereby drawing fuel into the outer end of the plunger bore via the drive bore without the aid of a low pressure pump, and reciprocation of each pumping plunger towards the outer limit position induces a high pressure in the outer end of the plunger bore, thereby discharging fuel from the outer end of the plunger bore into the high pressure line.

* * * * *

UNITED STATES PATENT AND TRADEMARK OFFICE

CERTIFICATE OF CORRECTION

PATENT NO. : 6,805,538 B2
DATED : October 19, 2004
INVENTOR(S) : Djordjevic

It is certified that error appears in the above-identified patent and that said Letters Patent is hereby corrected as shown below:

Title page,
Insert Item -- Related U.S. Application Data
[60] Provisional application No. 60/225,115, filed on August 14, 2000. --

Column 1,
Line 8, delete "Aug. 13, 2000" and insert -- Aug. 13, 2001 --

Column 8,
Line 2, delete "tower" and insert -- lower --.
Line 67, delete "subassembly" and insert -- sub-assembly --.

Column 9,
Line 14, delete "ah" and insert -- an --.

Signed and Sealed this

Fifteenth Day of March, 2005

JON W. DUDAS
*Director of the United States Patent and Trademark Office*